United States Patent [19]

Yoshida

[11] Patent Number: 4,471,213

[45] Date of Patent: Sep. 11, 1984

[54] UNIFORM AIRSTREAM DISTRIBUTION HAIR DRYER

[75] Inventor: Kiyoshi Yoshida, Hikone, Japan

[73] Assignee: Matsushita Electric Works, Ltd., Osaka, Japan

[21] Appl. No.: 382,216

[22] Filed: May 26, 1982

[30] Foreign Application Priority Data

Jun. 23, 1981 [JP] Japan ..... 56-98866

[51] Int. Cl.[3] ..... A45D 20/12

[52] U.S. Cl. ..... 219/370; 34/97; 219/373; 219/374; 219/376

[58] Field of Search ..... 219/367–370, 219/366, 375, 374, 376, 373, 380, 381; 34/96, 97, 98, 100, 101; 165/122–125

[56] References Cited

U.S. PATENT DOCUMENTS

| | | | |
|---|---|---|---|
| 1,038,410 | 10/1912 | Mies | 219/375 |
| 1,659,400 | 2/1928 | Frank | 219/374 |
| 2,257,342 | 9/1941 | Lintern | 219/368 |
| 2,429,733 | 10/1947 | Trent | 219/369 |
| 2,795,683 | 6/1957 | Teiger | 219/366 |
| 3,094,606 | 6/1963 | Ferris | 219/375 |
| 3,386,185 | 6/1968 | Angelillo | 34/97 |
| 3,534,197 | 10/1970 | Burnett | 219/375 |
| 4,025,754 | 5/1977 | Marzonie et al. | 219/368 |
| 4,090,061 | 5/1978 | Glucksman | 219/369 |
| 4,097,722 | 6/1978 | Soler et al. | 219/368 |
| 4,151,398 | 4/1979 | Maake | 219/374 |
| 4,232,454 | 11/1980 | Springer | 219/368 |
| 4,250,631 | 2/1981 | Moses | 219/370 |
| 4,308,670 | 1/1982 | Bonnema | 34/97 |

FOREIGN PATENT DOCUMENTS

| | | | |
|---|---|---|---|
| 2808210 | 9/1979 | Fed. Rep. of Germany | 219/370 |

*Primary Examiner*—C. L. Albritton
*Assistant Examiner*—Geoffrey S. Evans
*Attorney, Agent, or Firm*—Burns, Doane, Swecker & Mathis

[57] ABSTRACT

A hair dryer wherein a heater element disposed near an air outlet of a dryer casing comprises a plurality of band parts running zigzag along the plane of the outlet and the surface in the width direction of at least one of the band parts is directed toward the central part of the outlet, whereby at least a part of air stream produced by a rotated fan and reached the heater element is deflected toward the central part of the outlet and the speed of the air stream discharged out of the outlet can be made substantially uniform over the entire area of the outlet.

6 Claims, 14 Drawing Figures

UNIFORM AIRSTREAM DISTRIBUTION HAIR DRYER

This invention relates to improvements in hair dryers and, more particularly, to a hair dryer wherein an air stream can be discharged with a uniform air speed distribution out of an air outlet of the dryer.

Generally, in conventional hair dryers, a fan is rotated within a dryer casing, and thereby a generated air stream is heated as required and is discharged through a duct out of an air outlet. In this case, the rotation of the fan causes a centrifugal force to act on air so that the air stream will tend to concentratively flow along a wall which defines the duct specifically on the wall acted upon by the centrifugal force. Thus, the speed or amount of the air stream discharged out of a partial zone of the outlet remote from the particular wall will become less than that in a zone close to the wall, creating a problem in that a uniform drying action cannot be obtained over the entire area of the air outlet.

In order to solve this problem, on the other hand, it has been suggested to render uniform the air speed distribution of the discharged air stream over the entire area of the outlet by providing a projection on the inside surface of the dryer to deflect the air stream. However, there arise another defect in that, for example, the projection causes a turbulence to be produced downstream of the projection.

A primary object of the present invention is, therefore, to provide a hair dryer wherein the speed of air stream discharged out of the entire air outlet can be made substantially uniform and constant.

According to the present invention, there can be provided a hair dryer wherein a heater element is curved to run zigzag and inclined by a predetermined angle to the direction of discharging the air stream so that any turbulence and eventual air volume loss will not be caused and the air speed distribution of the air stream out of air outlet can be uniformed.

Another object of the present invention is to provide a hair dryer wherein the drying function can be improved without enlarging the contour of the hair dryer.

Other objects and advantages of the present invention will become apparent upon reading the following explanation of the invention detailed with reference to accompanying drawings, in which.

Figure 1:
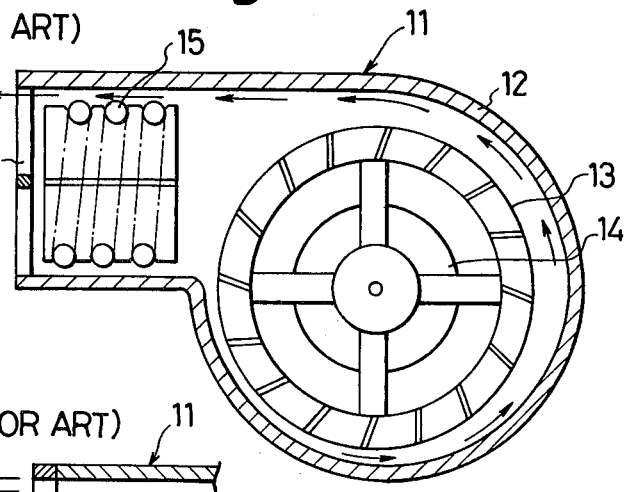
Fig. 1 (PRIOR ART)
FIG. 1 is a schematic sectional view of a conventional hair dryer.

While the present invention shall now be explained in the following with reference to the embodiments shown in the drawings, the intention is not to limit the invention only to the embodiments shown but is to rather include all design modifications, alterations and equivalent arrangements possible within the scope of appended claims.

Figure 2:
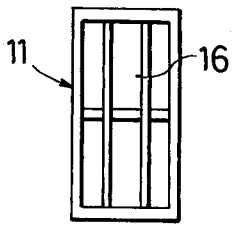
Fig. 2 (PRIOR ART)
FIG. 2 is a plan view of an air outlet of the hair dryer shown in FIG. 1.
Figure 3:
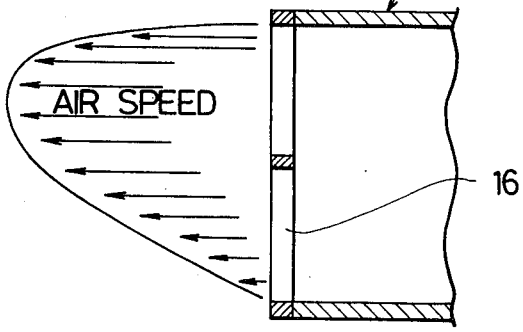
Fig. 3 (PRIOR ART)
FIG. 3 is an explanatory view showing as somewhat exaggerated the air speed distribution of an air stream discharged out of the air outlet in the case of the dryer in FIG. 1.

Prior to the description of the present invention, references shall be made first, more in detail, to the conventional hair dryers shown in the drawings for the purpose of better understanding of the present invention. In the hair dryer of the type shown in FIGS. 1 and 2, a centrifugal fan 13 is provided to be rotated by a motor 14 within a circular housing part of a dryer casing 11 so that, with the rotation of the fan 13, an air stream will flow through a coiled heater member 15 supported on composite mica plates or the like over to a substantially rectangular outlet port 16. However, in this formation, there have been defects in that, as centrifugal force of the fan 13 will act on the air stream, the air speed or amount of the stream discharged through a zone above the central part of the outlet port 16 in the drawings will become larger than in another zone below the central part and, as shown in FIG. 3, the air speed of air discharged out of the outlet port will become rather concentrative to one of the zones and non-uniform, so that the drying action will fluctuate at different zones of the outlet port 16.

Figure 5:
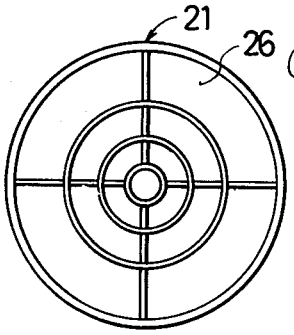
Fig. 5 (PRIOR ART)
FIG. 5 is a plan view of an air outlet of the hair dryer shown in FIG. 4.
Figure 4:
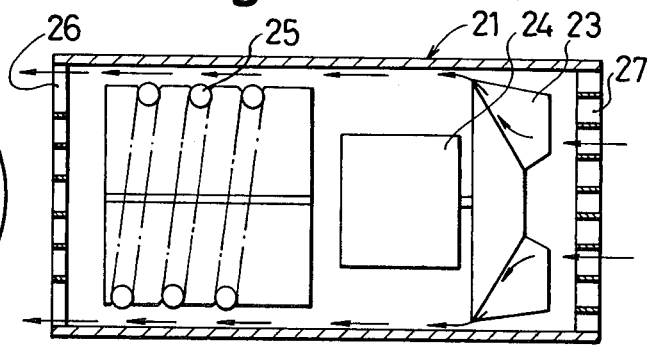
Fig. 4 (PRIOR ART)
FIG. 4 is a schematic sectional view of another example of conventional hair dryers.
Figure 6:
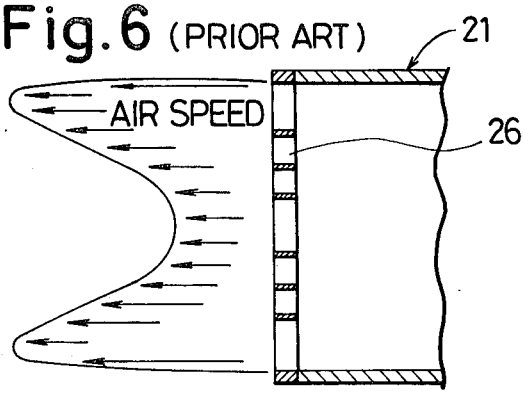
Fig. 6 (PRIOR ART)
FIG. 6 is an explanatory view showing as somewhat exaggerated the air speed distribution of an air stream discharged out of the air outlet in the case of the hair dryer of FIGS. 4 and 5.

On the other hand, in the hair dryer of the type shown in FIGS. 4 and 5, a propeller fan 23 is arranged to be rotated by a motor 24 to generate an axial flow of air through a cylindrical dryer casing 21 so that, with the rotation of the fan 23, air will be sucked in through a suction port 27 at an end of the casing, passed through a heater member 25 and discharged out of a substantially circular outlet port 26 at the other end of the casing 21. In this formation, however, there have been defects in that, as the axial air flow tends to radially expand and thus to flow somewhat concentratively along the inner peripheral surface of casing 21, the air speed of the air flow discharged through the peripheral zone of the circular outlet port 26 will be higher than that through the central part of the port and, as shown in FIG. 6, the air speed distribution of the air flow out of the outlet port 26 will become non-uniform and the drying action will fluctuate depending on the zone in the entire area of the outlet port 26.

Figure 7:
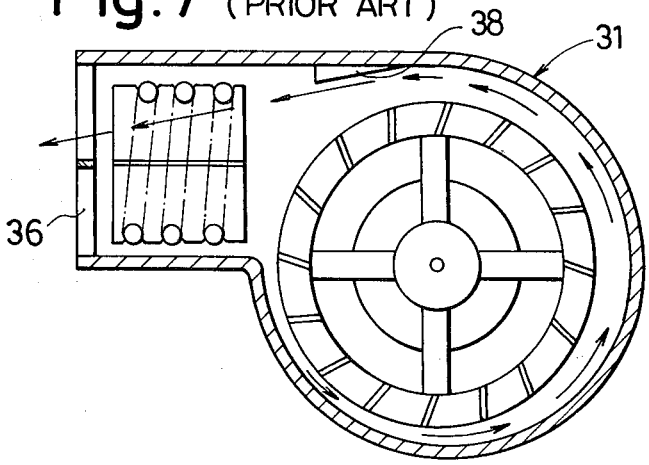
Fig. 7 (PRIOR ART)
FIGS. 7 and 8 are schematically sectioned views respectively of an example of improvements in the conventional hair dryers.

Further, in the case of another conventional hair dryer of the type employing the centrifugal fan as in FIG. 7, a projection 38 is provided on the inside surface of a circular dryer casing 31 which per se is similar to the casing of the dryer of FIGS. 1 and 2, so as to lead the air flow toward the central part and the zone below the same in an outlet port 36. However, a turbulence will be caused to occur downstream of this projection 38 and, though the air speed of air flow discharged out of the outlet port can be unified to some extent, the entire flow speed is deterioratively influenced to be improper for achieving the optimum drying action.

Figure 8:
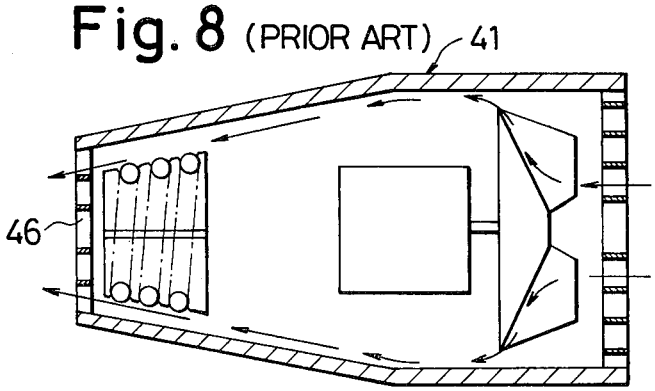
Fig. 8 (PRIOR ART)

In a further conventional hair dryer as in FIG. 8 employing the propeller fan, a cylindrical dryer casing 41 is formed to be slightly tapered in an attempt to concentrate the air stream to the central part of a circular outlet port 46. According to this arrangement, the speed of the air stream discharged out of the port 46 can be uniform, but the discharged air stream is constricted to a smaller area and is thus undesirable.

The present invention has been suggested to solve the foregoing various problems. Referring to an embodiment of the present invention shown in FIGS. 9 to 11, as the most remarkable feature of the hair dryer of the present invention, a heater element arranged near an air outlet port is inclined to optimumly deflect generated air stream. More specifically, a dryer casing 101 is provided with a circular housing part 102 and a duct part 102*a* connected to the housing part 102 while extending therefrom by a relatively short linear length. A wall of the duct is disposed substantially in tangential relation to the housing part. In the housing part 102, a centrifugal fan 103 is borne with the rotary shaft slightly displaced away from the axis of the duct part 102*a* and the center of the circular housing part 102. The fan 103 is provided to be rotated by a motor 104 housed also in the housing part 102 and preferably having its output shaft connected directly to the shaft of the fan 103.

Figure 9:
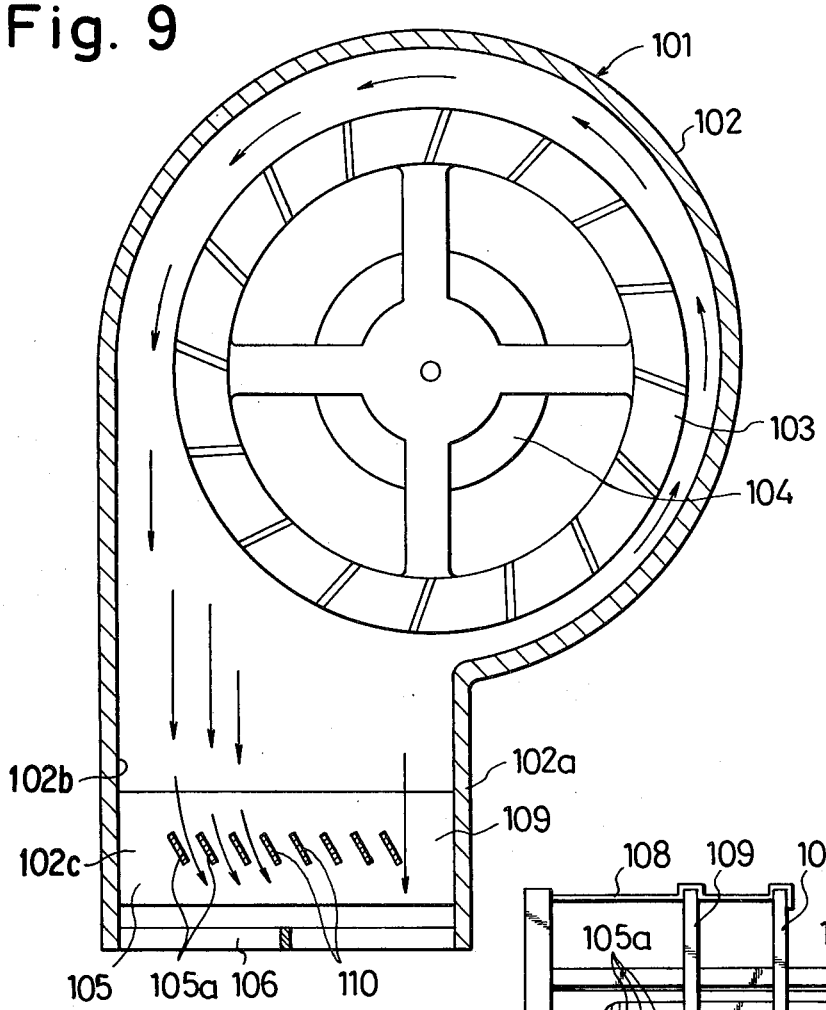
FIG. 9 is a schematic sectional view of an embodiment of a hair dryer according to the present invention.

In the duct part 102*a*, a relatively thin heater element 105 is arranged and an end of the duct part constitutes an outlet port 106 of, for example, a rectangular shape. The heater element 105 is bent back and forth to run zigzag inside along the plane of the outlet port 106 or perpendicularly with respect to the axis of the duct part 102*a*. In the illustrated embodiment, the heater element 105 is turned, for example, seven times so that eight parallel band parts 105*a* will be positioned within the duct part 102*a*. The respective band parts 105*a* are inclined in their width direction to extend forwardly and diagonally away from the wall of the duct part 102*a* which is tangential to the housing part 102. The two outermost ones of the band parts 105*a* of the heater element 105 are extended toward the same side wall of the duct part 102*a* and are fixed to a fixing plate 107 which extends in the width direction along the axis of the duct part and in the longitudinal direction between opposing walls of the duct part to be fixed thereto. Further, supporting metal pieces 108 and 108*a* extending across the duct part 102*a* are fixed respectively to the longitudinal end portions of the fixing plate 107, and heater supporting base plates 109 and 109*a* are fixed between the supporting metal pieces 108 and 108*a*. Heater inserting slits 110 and 110*a* are made in the respective heater supporting base plates 109 and 109*a* (only those 110 in one heater supporting plate 109 are shown in FIG. 9), the slits extending diagonally in the same manner as the band parts 105*a* of the heater element, as aligned in the height direction of the duct part 102*a*. The respective band parts 105*a* of the heater element are inserted through these slits 110 and 110*a* so as to be positively held in the inclined position.

Arrangements for feeding and interrupting an electric power to the motor 104 and for providing a means to the dryer casing are well known to the skilled in the art and shall not be explained and illustrated. Such arrangement as disclosed in, for example, U.S. Pat. No. 3,237,142 may be applicable to that of the power feeding.

Figure 11:
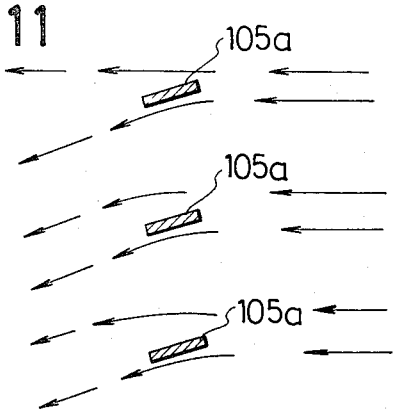
FIG. 11 is an explanatory view showing the relation between the heater element and the air stream in the hair dryer of FIG. 9.
Figure 12:
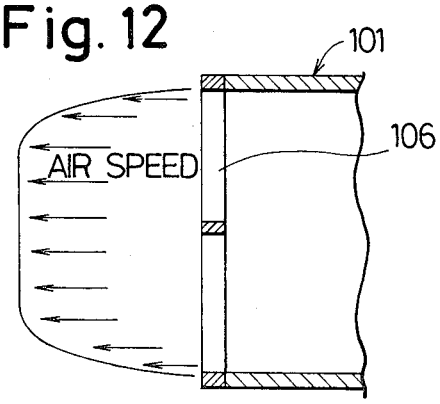
FIG. 12 is a fragmentary section of the hair dryer shown in FIG. 9 for explaining the air speed distribution of the air stream discharged out of the air outlet.

Referring to the operation of the foregoing embodiment, with the rotation of the fan 103, and air stream is generated as accelerated as it approaches the inner peripheral surface of the dryer casing while being subjected to the centrifugal force by the fan 103 and is led forwardly to the duct part 102*a* to reach the heater element 105. In the absence of the present invention, the airstream would be discharged having higher and lower speed zones, which zones being spaced in the direction depicted in FIG. 6. The air stream is heated, as required, by the respective band parts 105*a* of the heater element and deflected in the flowing direction along the respective band parts 105*a* inclined as referred to, to be discharged out of the outlet port 106. In such case, as shown in FIG. 11, the air stream is deflected away from the tangential wall 102*b* of the duct part 102*a*, downward in the drawing toward the lower speed zones. A gap 102*c* formed between the wall 102*b* and the nearest one of the band parts 105*a* is unobstructed to enable air to flow forwardly therethrough (see FIGS. 9, 11 and 13). Thus, an even stream of air is directed not only to a zone along the tangential wall 102*b* but also to other zones of the outlet port so that, as shown in FIG. 12, the speed of the air stream will be made substantially uniform over the entire cross-section of the outlet port 106. Further, in this case, as the heater element 105 is formed of a relatively thin material, an effective deflecting action can be realized and neither turbulence nor air volume loss will be brought about.

Figure 10:
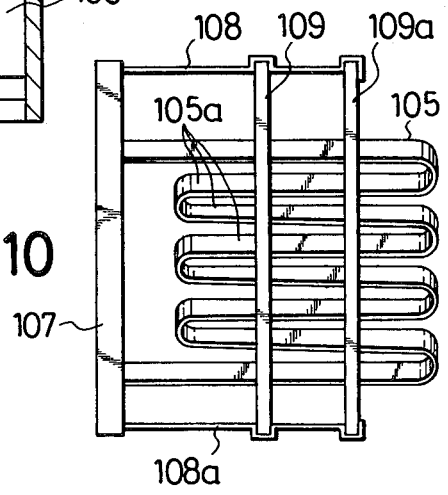
FIG. 10 is a fragmentary plan view as magnified of a heater element employed in the hair dryer of FIG. 9.
Figure 13:
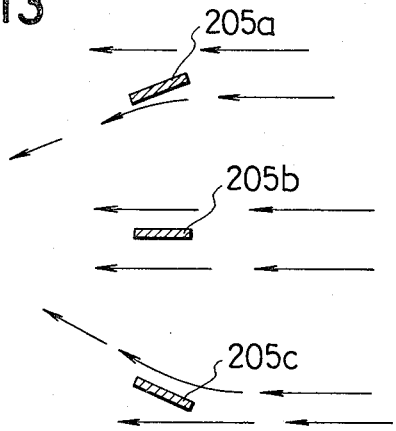
FIG. 13 is an explanatory view showing similarly to FIG. 11 the relation between the heater element and the air stream in the case of another embodiment of the present invention in which the heater element is modified.

It will be apparent that the foregoing heater element shown in FIGS. 9 and 10 can be adopted also in such hair dryer comprising the cylindrical dryer casing having air inlet and outlet ports at the respective ends and the propeller fan as shown in FIGS. 4 and 5. In this case, the band parts of the heater element may be divided into, for example, three groups of different inclinations as seen in FIG. 13, wherein the upper group 205*a* of the heater band parts are inclined diagonally away from the peripheral wall of the duct part on the side of downstream edge of the band parts, the intermediate group 205*b* are set horizontally along the axis of the duct part, and the lower group 205*c* are inclined diagonally upward oppositely to the group 205*a*, whereby the air stream can be unified in the speed or amount in all radial directions and over the entire circular area of the outlet port. It will be easily understood that, in the case of, for example, eight band parts, the upper group 205*a* to be directed diagonally downward may include three band parts, the intermediate group 205*b* may include two and the lower group 205*c* may be of three. Accordingly, even when the invention is applied to the hair dryer of the type shown in FIGS. 4 and 5, the air stream speed in the peripheral zone and that in the central zone in the outlet port can be made uniform and such air speed characteristics as shown in FIG. 12 can be similarly obtained.

Figure 14:
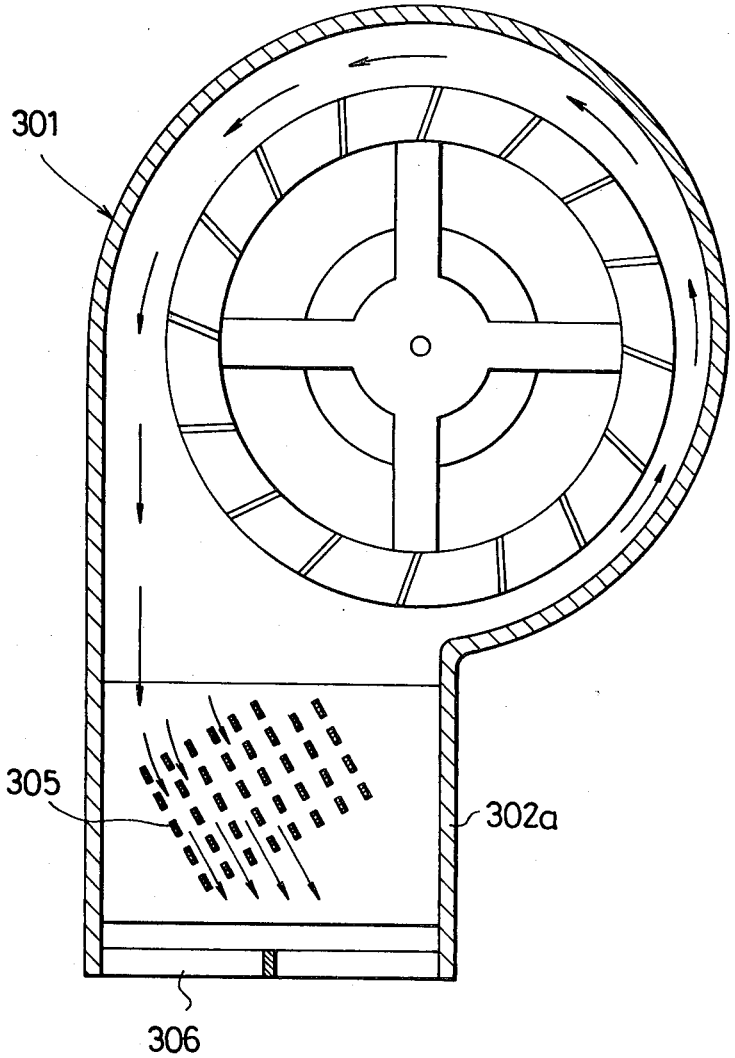
FIG. 14 is a schematic sectioned view of a hair dryer in another embodiment of the present invention.

FIG. 14 shows another embodiment of the present invention, in which a plurality of heater elements 305 respectively being such arrangement as shown in FIG. 10 are provided in a duct part 302*a* of a dryer casing 301. In this case, the respective heater elements 305 are properly arranged so that the similar band parts will be positioned as aligned in the width direction in parallel relation in a plurality of planes but as directed diagonally away from the wall of the duct part opposite to the tangential wall, as spaced at substantially regular intervals. In the illustrated embodiment, four heater elements each having eight band parts and one heater element having four band parts are arranged as an example, as parallelly separated from each other so as to be relatively closer to the outlet port 306 on the side of the tangential wall and relatively farther from the outlet port 306 on the other side, differring from the embodiment shown in FIG. 9. In the present instance, the air stream having reached these heater elements 305 as generated by the fan will be deflected as indicated by the arrows along the planes of the band parts of the respective heater elements aligned in the width direction and the air stream deflecting action and air heating characteristics will be higher than in the case of a single heater element of FIG. 9. It will be easily understood that other arrangements in the dryer and operation of this embodiment of FIG. 14 are substantially the same as of the embodiment of FIG. 11.

According to the present invention as described above, the speed of the air stream discharged out of the entire outlet port of the hair dryer can be made uniform. The thin heater element which is used causes neither turbulence nor air volume loss. Also, a uniform drying action can be given to hair and, generally, the effects of the hair dryer can be effectively improved.

What is claimed as my invention is:

1. A hair dryer providing an airstream discharged out of said dryer with a substantially uniform speed distribution, the dryer comprising a casing defining therein a hollow space and an airstream duct communicating with said hollow space and having a tangential wall and a forwardly disposed outlet port, a motor-driven centrifugal fan housed within said hollow space in said casing to generate said airstream such that said airstream travels in a forward direction through said duct and tends to include a high speed zone disposed alongside said tangential wall and a lower speed zone spaced away from said side wall in a first direction within said airstream duct, and heating means disposed within said airstream duct adjacent said outlet port for heating the airstream, said heating means comprising an elongated thin band of an electrically conductive heat-generating material bent into zigzag form to define a plurality of mutually parallel band parts spaced apart in said first direction and disposed within said high and lower speed zones, said band parts extending transversely relative to said first direction and said forward direction, at least one of said band parts being disposed within said higher speed zone of the airstream and having a surface inclined forwardly away from said wall and toward said lower speed zone of the airstream to deflect air from said higher speed zone of the airstream to deflect air from said higher speed zone toward said lower speed zone and render more uniform the air speeds of said zones, said tangential wall being spaced in said first direction from the nearest one of said band parts which extends forwardly and away therefrom to form with such band part a gap, said gap being substantially unobstructed to allow air in said airstream to flow forwardly therethrough substantially parallel to a longitudinal axis of said airstream duct.

2. A hair dryer according to claim 1 wherein said casing comprises a circular part, said fan and motor are arranged within said circular part with the rotary center of at least the fan displaced from the center of the circular part.

3. A hair dryer according to claim 1 wherein said casing comprises a circular part, said fan and motor are arranged within said circular part with the rotary center of at least the fan displaced from the center of the circular part, and said heating means comprises a plurality of sets of said zigzag-bent band parts, respective ones of said sets of band parts being arranged in a plurality of planes spaced in parallel to each other substantially at regular intervals, and respective ones of said band parts of the respective sets being all inclined.

4. A hair dryer according to claim 1, wherein said casing includes a substantially disk-shaped hollow circular body, said airstream duct being disposed in substantially tangential relationship to said body, with said wall of said airstream duct being disposed tangentially relative to an inner wall of said hollow body, said first direction of said airstream duct extending from said wall in a direction transversely to a longitudinal axis of said airstream duct, said fan being rotatable about an axis disposed transversely relative to said longitudinal axis of said airstream duct and being offset therefrom in a direction away from said wall.

5. A hair dryer according to claim 1, wherein all of said band parts are inclined in the same manner as said at least one band part.

6. A hair dryer according to claim 1, wherein said airstream duct includes another wall disposed opposite said first-named wall, said other wall forming a gap with the nearest band part, which last-named gap is substantially unobstructed to allow air to flow forwardly therethrough substantially parallel to said longitudinal axis of said airstream duct.

* * * * *